United States Patent [19]

Ihli

[11] 4,335,977

[45] Jun. 22, 1982

[54] WATER STORAGE AND DISTRIBUTION SYSTEM

[76] Inventor: Vincent V. Ihli, P.O. Box 261, Buena Park, Calif. 90620

[21] Appl. No.: 142,694

[22] Filed: Apr. 22, 1980

[51] Int. Cl.[3] ..... B63B 35/00; E02B 1/00

[52] U.S. Cl. ..... 405/52; 114/256; 405/32; 405/127; 405/210

[58] Field of Search ..... 405/32, 52, 210, 127; 114/256; 137/236, 236 S; 210/170

[56] References Cited

U.S. PATENT DOCUMENTS

| | | | |
|---|---|---|---|
| 2,976,692 | 3/1961 | Suderow | 405/32 X |
| 3,230,967 | 1/1966 | Castro | 137/236 |
| 3,517,513 | 6/1970 | Renshaw et al. | 405/52 |
| 3,837,310 | 9/1974 | Toyama | 405/210 X |
| 4,106,303 | 8/1978 | Shimada et al. | 405/210 X |
| 4,231,873 | 11/1980 | Swigger | 405/52 X |

*Primary Examiner*—David H. Corbin

*Attorney, Agent, or Firm*—Poms, Smith, Lande & Rose

[57] ABSTRACT

The present system includes arrangements for the low-cost storage of rain water runoff, and arrangements for distributing this runoff water during arid seasons. The system may be located at the sea coast where a water runoff channel enters the ocean, and where there is available protected ocean water which is of reasonably substantial depth. Heavy duty plastic containers are provided for receiving the fresh water runoff from a point just before the water would normally enter the ocean. Pumping station arrangements are also provided for distributing the water inland where it is required during arid seasons. The flexible plastic water containers may be many tens of feet in their dimensions, both horizontally and vertically. The upper edges of the containers may be secured to large floats, and suitable lightweight rigid covers may be provided to extend across the tops of the water containers. Suitable filtration and treatment arrangements are provided for processing the water in the course of its distribution for use. The floats along the upper edges of the flexible plastic containers may be partially filled with water for stability and with air for buoyancy and may be topped with a fiberglass shell to which the rigid bridging structure may be secured.

10 Claims, 10 Drawing Figures

WATER STORAGE AND DISTRIBUTION SYSTEM

FIELD OF THE INVENTION

The present invention relates to water storage and distribution systems, particularly those applicable to emergency water shortage conditions.

BACKGROUND OF THE INVENTION

Many parts of the world suffer from periodic water shortages. This is particularly true of geographic areas where the rainfall occurs only during a relatively short rainy season and where the remainder of the year is normally dry. When various factors combine to produce less than normal rainfall for one or two of the normal rainy seasons, emergency drought conditions are initiated and frequently become oppressive, if not diasastrous. In the California area several dry years which extended through the 1977–1978 normal winter rain season resulted in water shortages so that rationing and strong conservation measures were needed.

On the other hand, during normal rainfall years, there are many instances when the flood control water runoff channels carry many acre feet of water into the ocean. This fresh water is forever lost, once it becomes mixed with the salty ocean water and is thereafter unusable for drinking or agricultural purposes.

A principal object of the present invention is to save this runoff water and make it available for distribution.

SUMMARY OF THE INVENTION

In accordance with the present invention, huge water storage containers made of flexible plastic material are provided in sheltered ocean waters adjacent a flood control or other rain water runoff channel where substantial quantities of water are normally dumped into the ocean. A screened pickup point is provided within the runoff channel, and the water from this point is applied through a conduit to a series of large flexible plastic containers moored in the ocean at a nearby sheltered point where the water is of substantial depth.

Features of the invention include the use of floats along the upper edges of the plastic containers to maintain reasonable purity and to avoid contamination of the fresh water within the containers from the ocean or from outer sources. An output filtration and purification processing point may be provided to process the water as it is being pumped out for distribution. The floats at the top of plastic containers may be partially filled with water and partially inflated with air to provide suitable stabilization and flotation properties. Suitable air and water valving and control arrangements are provided for both controlling the flow of water to and from the main fresh water storage containers and also for controlling the flow of air and water into the floats at the top of the containers.

In accordance with advantages of the present invention, relatively low cost water containment and storage arrangements are provided as compared with the much more costly dams which are frequently used for water storage purposes. Additional advantages of the present system are the recreational functions which may be combined with the water storage function. More specifically, sailboats and other craft may be accessed from the floating structure, fishing may be accomplished from the decks on top of the floats and other aquatic sports may be enjoyed.

It is also noted that, in the use of dams for water storage and flood control, there is a basic conflict, as an empty dam is best for flood control, and a full dam is the best water supply. No such conflict exists relative to the present water storage system.

Other objects, features, and advantages of the invention will become apparent from a consideration of the following detailed description and from the accompanying drawings.

DETAILED DESCRIPTION

Figure 1:
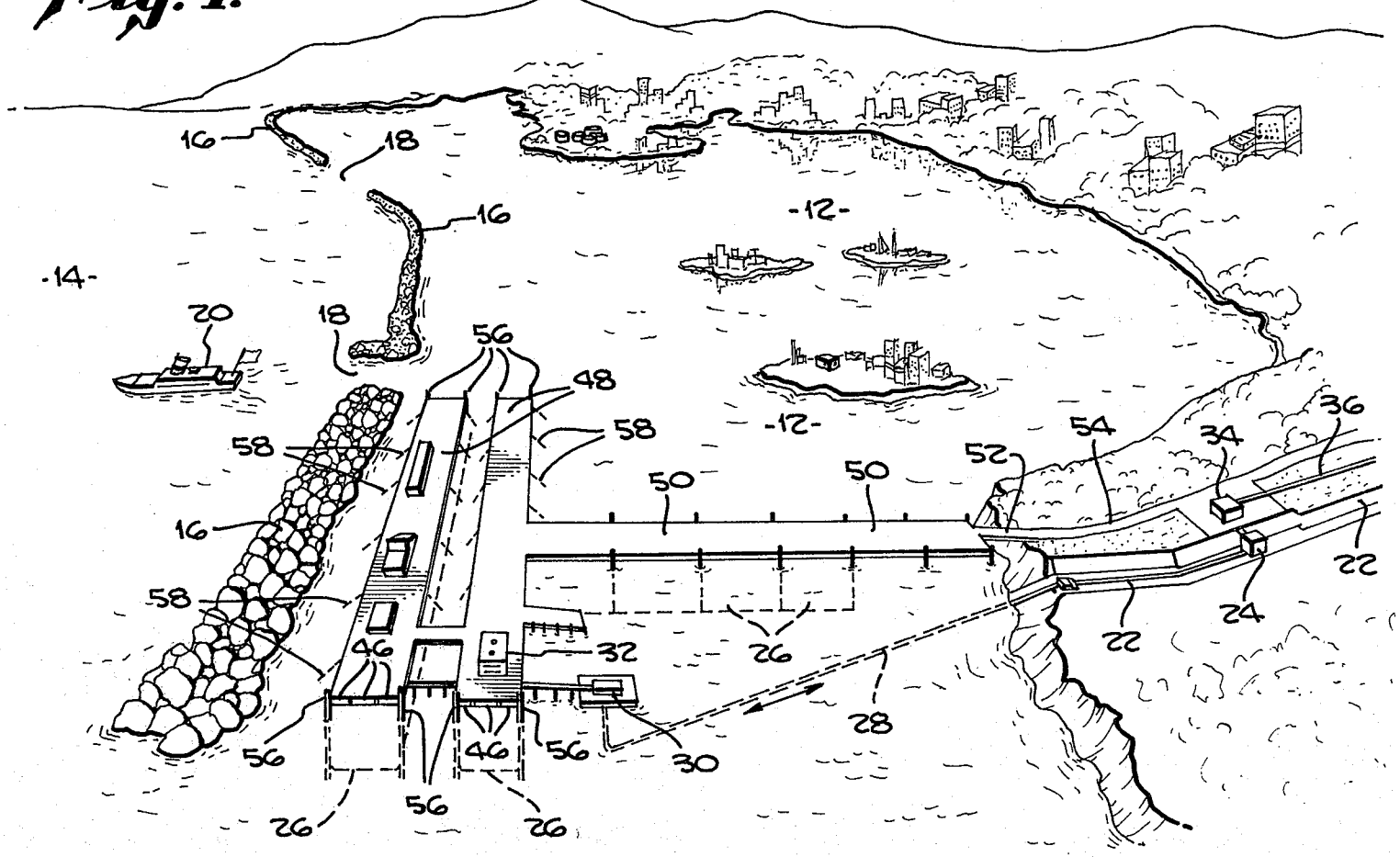
FIG. 1 is an overall view of an installation illustrating the principles of the present invention.

Referring more particularly to the drawings, FIG. 1 shows a seaport such as that for Los Angles and Long Beach, including a harbor area 12 separated from the open ocean 14 by a breakwater 16. Suitable openings 18 in the breakwater 16 permit the entering and departure of ships such as the vessel 20. In many areas of the world, rainfall is sporadic with much of the year being relatively dry, but with very heavy rainfall up to several inches during a single day occasionally occuring during the rainy season. In order to accommodate the runoff of water, flood control channels are provided, and the point where a major flood control channel 22 meets the ocean is shown at the lower right in FIG. 1.

As mentioned above, despite the dumping of thousands of acre feet of water into the ocean through the flood control channel 22, areas such as Los Angles and Orange counties from time to time experience water shortages. The arrangements provided in accordance with the present invention for utilizing the runoff water to avoid these water shortages include a water intake 24, and large flexible plastic containers 26, which are mounted within the harbor area 12 and produced from the open ocean 14 by the breakwater 16. Suitable pipe arrangements including the main conduit 28 extend from the flood control channel 22 to the control facilities 30 and 32, from which points the water is distributed to the storage containers 26.

During the dry season of the year, when it is desired to utilize the fresh water stored in the containers 26, the direction of water flow through the main conduit 28 is reversed, and the smaller capacity pumping units included in stations 30 and/or 32 pump the water from the storage containers 26 to the main distribution pumping station 34, from which the water is pumped inland into existing water distribution systems. The main distribution conduit 36 shown extending directly from the pumping station 34, may in fact be mounted along the bottom of the flood control channel 22 for a considerable distance.

The floating station 30 provides output filtration and purification, as the water is being pumped from the storage containers 26 to the main pumping station 34. Incidentally, the passage of considerable periods of time, often months, while the water is standing in the flexible plastic containers 26 will permit the settling of particulate material which may often be included in the rushing runoff water picked up at point 24.

Figure 2:
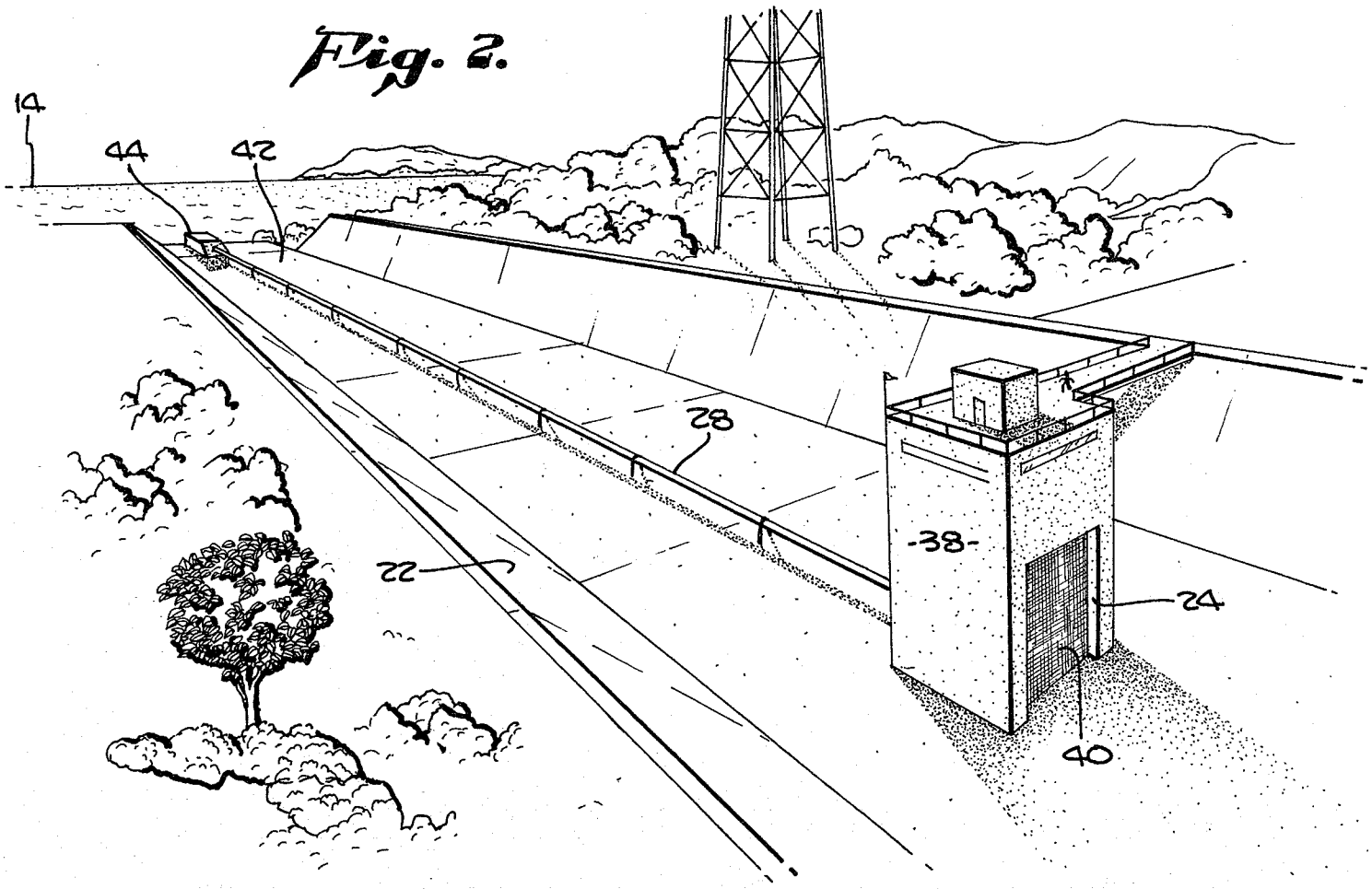
FIG. 2 is an enlarged showing of an intake point in a water runoff channel.

FIG. 2 is an enlarged showing of the water intake point 24 including the reinforced concrete structure 38, and a heavy screen 40 which will prevent major objects, such as logs and other debris too large for passage through the conduit 28 from being picked up. If desired, the conduit 28 within the flood control 22 may be mounted firmly in a corner of its structure or may be actually embedded in its surface, to prevent possible damage by the rapidly flowing water and objects which may be contained therein. At the outlet or mouth 42 of the flood control channel 22 is a transition structure 44 which protects the conduit 28 at the point where it changes angle from the floor of the flood control channel to go along the bottom of the harbor.

Incidentally, returning to FIG. 1, the upper edges of the flexible plastic reservoirs 26 are supported by large floats 46. On top of the floats 46 are semi-circular shells which will be shown in greater detail in other figures of the drawings, and to which the deck structures 48 are secured. As indicated by the additional deck structures 50, a bridge may be provided from the mainland out to the decks 48, and a final ramp 52 may connect the deck structure 50 which is closest to the land to an access road 54. The installation may be secured in position on the bottom of the harbor by suitable corner posts or pilings 56 and additional guying cables 58 which are angled away from the posts 56 and secured to the bottom of the harbor 12.

Figure 3:
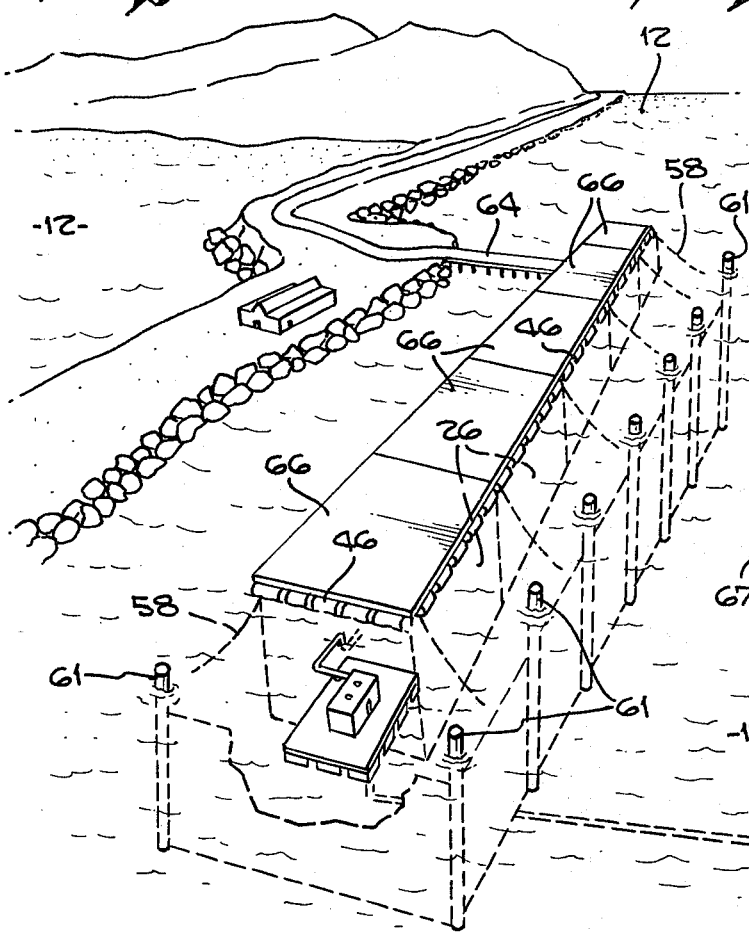
FIG. 3 is an illustrative showing of an alternative installation.

FIG. 3 shows an alternative constructional arrangement in which a lesser number of reservoir units 26 are provided and in which all of the control functions are included in the floating unit 62 shown at one end of the series of reservoirs 26. In the case of the unit of FIG. 3, a permanently constructed bridge 64 provides access to the decks 66.

Figure 3A:
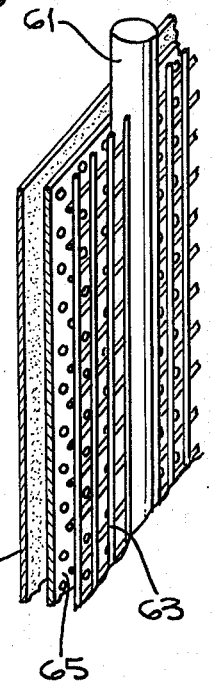
FIG. 3A shows a wave arrester and absorber structure.

External to the basic reservoir structure shown in FIG. 3 is an optional structure for protecting the reservoir units against damage from huge waves which might occasionally roll in from the open ocean. As shown schematically in FIGS. 3 and 3A, the wave protection structure includes a series of pilings 61 or other strong structural members, perhaps of reinforced concrete for deeper water; a wave arrester 63 formed of a heavy screen of corrosion resistant metal or nylon cables; a water screen 65 made of heavy plastic material, with a series of regular spaced openings; and a wave absorber 67 formed of a continuous sheet of plastic material. The cables forming the screen may have openings in the order of one foot square, and may be supported directly from the pilings or reinforced concrete structures 61. The water screen 65 and wave arrestor 67 may be suspended from cables extending between the support structures 61. It is to be understood that the wave protection arrangements may not be needed in cases such as that illustrated in FIG. 1 where protection is provided by existing breakwater structures against the force of waves from the open ocean.

Figure 4:
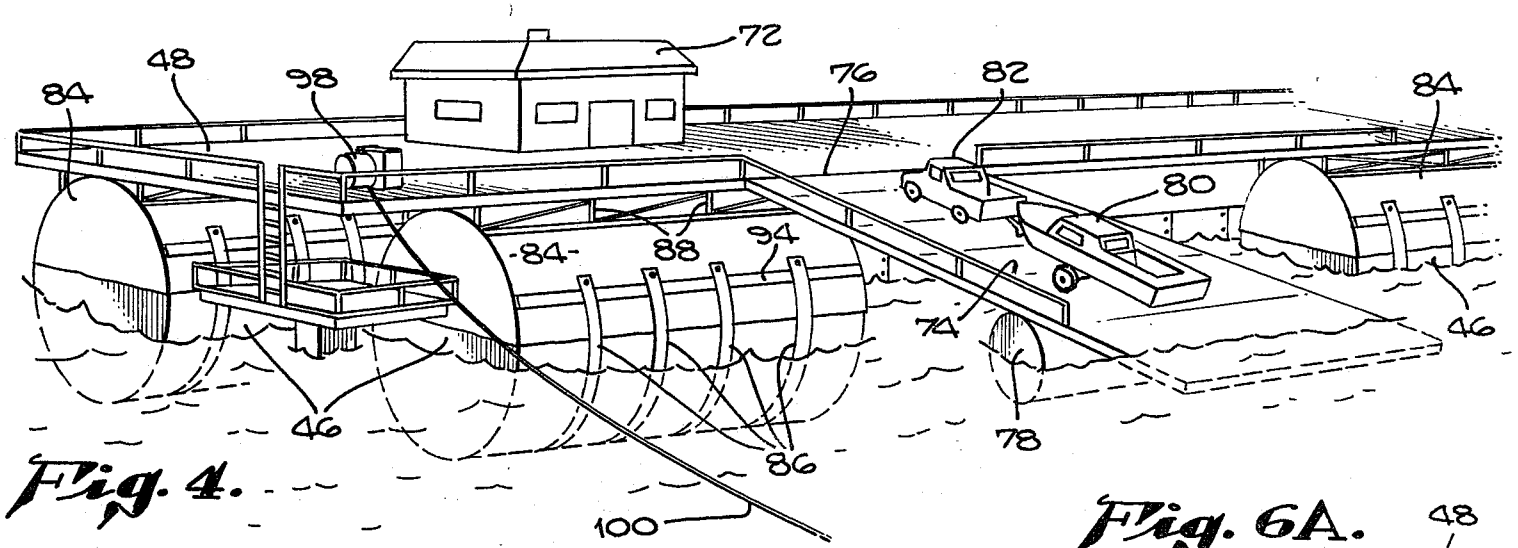
FIG. 4 is an alternative showing of a typical installation on a larger scale, and indicating recreational possibilities for the structure.

FIG. 4 is an enlarged view of one corner of the reservoir structure showing the pontoons 46 on an enlarged scale and also showing the deck 48. A building 72 is shown mounted on the deck 48, and this structure could be the project engineering center, as shown at 32 in FIG. 1, or any other type of public building, such as a restaurant or a store, which may be located on the floating deck. The ramp 74 is pivotally mounted to the deck 48 at the interface 76 where the two structures join, and its outer end is supported by any suitable float arrangements such as the pontoon 78. Pleasure craft such as the boat 80 may be launched through the use of the truck 82 and ramp 74.

Fiberglass shells 84 are mounted on the floats or pontoons 46 and may be secured to the pontoons 46 by any suitable means, for example, by straps 86. The decks 48 are mounted by suitable struts 88 to the upper sides of the fiberglass shells 84.

Figure 5:
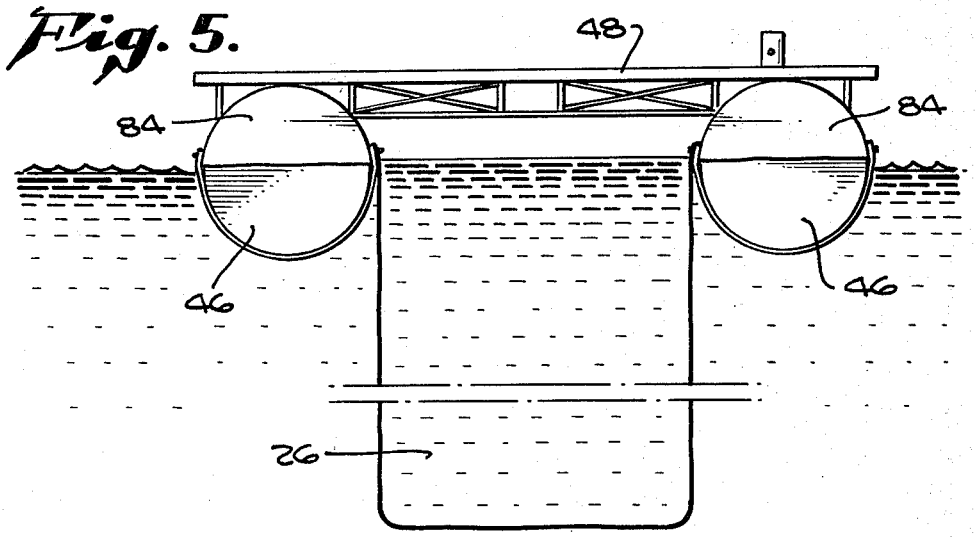
FIGS. 5, 6 and 6A are detailed showings of the floats, and typical installations implementing these float arrangements.
Figure 6A:
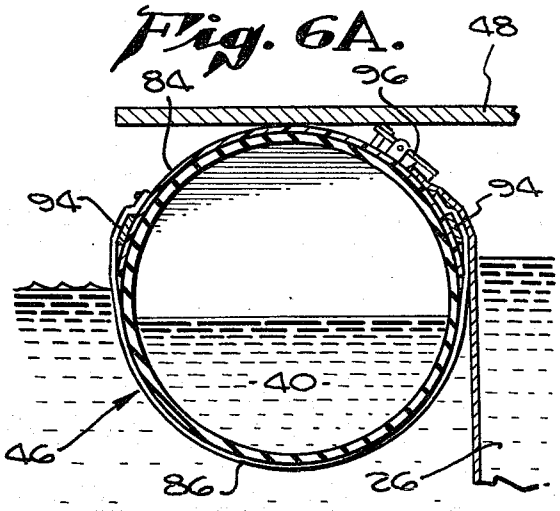
Figure 6:
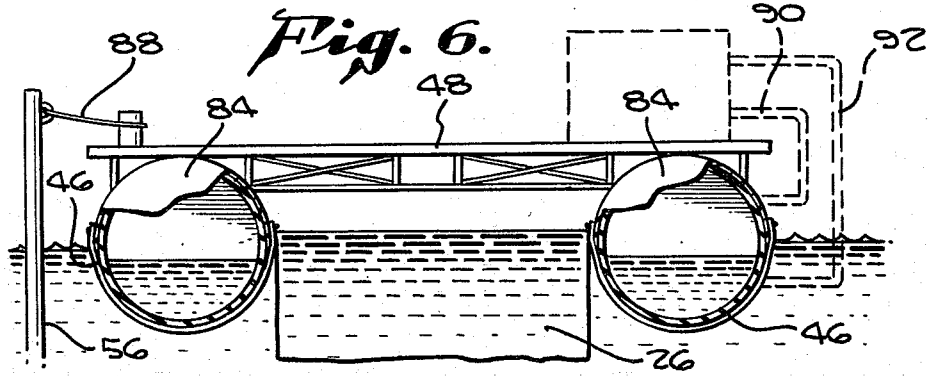

FIGS. 5 and 6 are diagrammatic showings indicating one possible arrangement for the stabilized flotation of the floats 46 and the fiberglass shells 84. More particularly, as shown in FIG. 6, the floating structure may be secured to the posts or pilings 56 by cable, such as that shown at reference mineral 88. Also, each of the floats 46 may be partially filled with water and also partially filled with air. In order to control the stabilization against wave action and also the desired flotation, suitable conduits 90 and 92 for air and water, respectively, may be provided to each of the floats. These conduits 90 and 92 are flexible, and may be connected to control lines extending along the edge of the deck, if desired, with associated valving to control the flow of air and water to each individual pontoon. Under static conditions of operation, no flow of air or water in or out would be contemplated, but suitable controls are employed to obtain the desired initial partial filling of the floats; in addition, if one of the heavy flexible floats 46 becomes punctured, it may be desirable to unstrap it from its associated fiberglass shell, fill it further with water, and remove it for replacement by a perfectly sealed float or pontoon. Incidentally, in this connection, the flotation of the units is such that only a portion of the total number of floats is required to maintain the structure in position with the upper edges of the reservoirs well above the salt water. It is also noted that the fiberglass shells 84 are substantially semi-cylindrical, including nearly semicircular ends, and face down, so that they will trap air within their volume and will be self supporting in calm seas even without the floats 46. Also, in securing the reservoirs to the floats, upper edges of the heavy film forming the reservoirs 26 may be folded over upon themselves several times and are secured under clamping strips such as that shown at 94 in FIG. 6A, with suitable clamping members 96 bearing on the stripping 94 to hold the upper edge of the heavy film in place under the stripping 94.

Incidentally, referring back to FIG. 4, it may be noted that the winch 98 may be employed to tighten the cable 100 which is secured to the harbor bottom, by any suitable means such as a heavy anchor, for example, to hold the structure in its desired location. Incidentally, the use of the posts or pilings 56 is to be preferred, but it is understood that, if desired, the reservoirs could be held in place entirely from the bottom of the harbor directly by cables such as cable 100 shown in FIG. 4.

Figure 7:
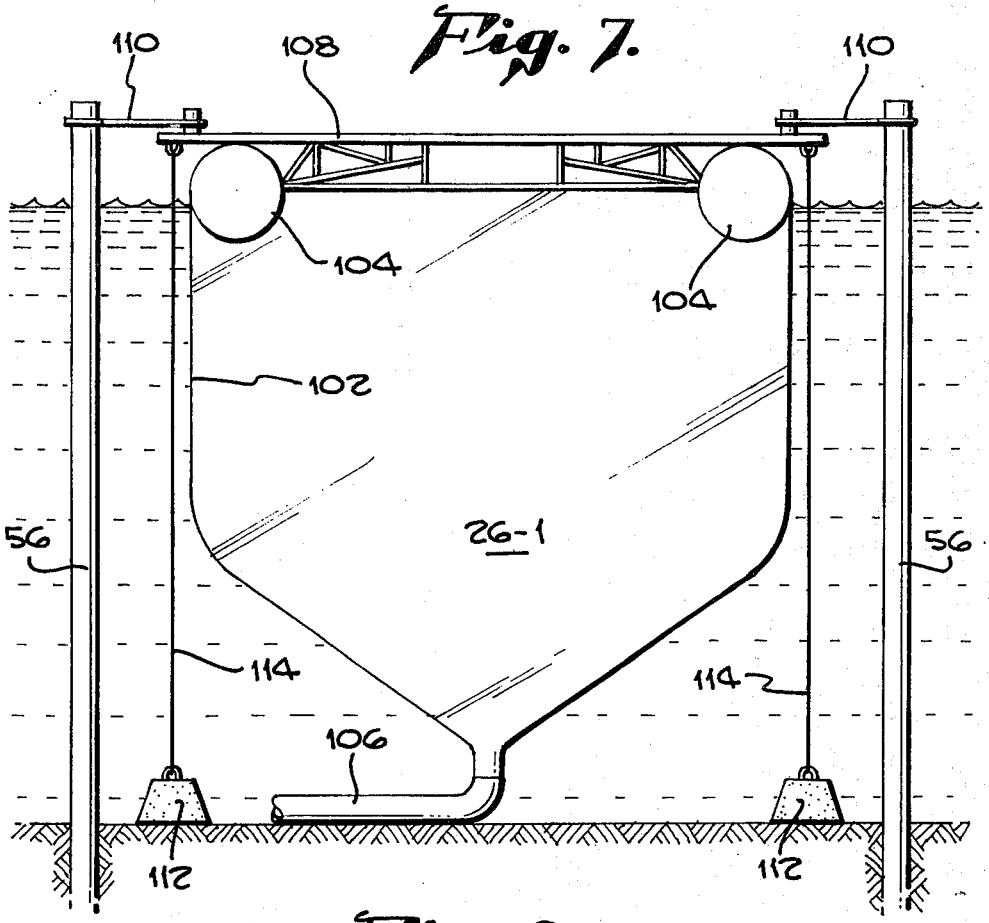
FIG. 7 is a cross-sectional view illustrating one possible configuration of one of the fresh water reservoirs.
Figure 8:
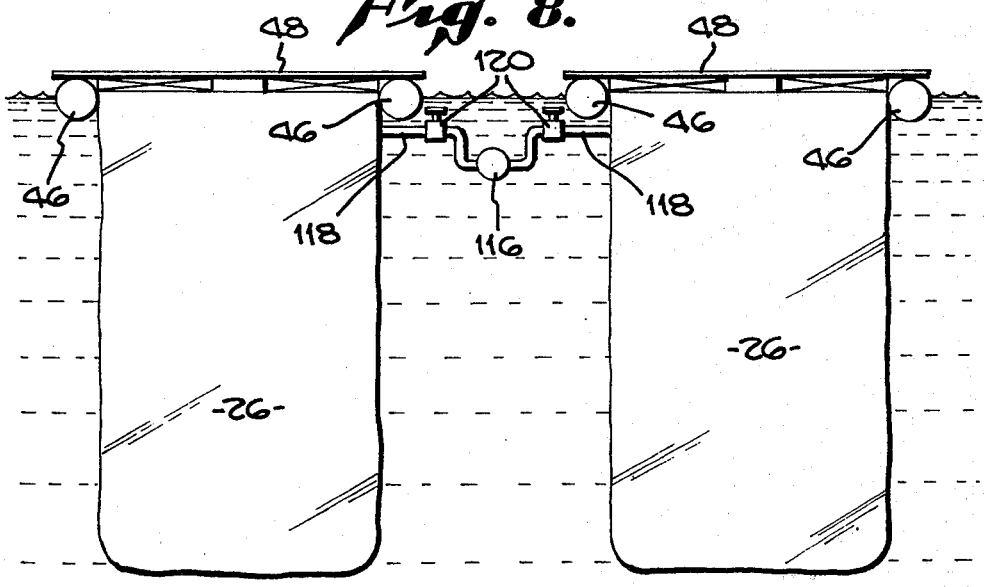
FIG. 8 is a schematic showing of the manifold-type valve connections from the main fresh water conduit to the individual fresh water containers, in another alternative arrangement.

FIGS. 7 and 8 show alternative arrangements for feeding water to, and drawing water from, the reservoirs. Referring to FIG. 7, it shows the reservoir 26-1 with the heavy film 102 secured to the outside of the floats instead of from the inside of the floats, as shown in other figures of the drawing. In addition, instead of a relatively rectangular bottom, the lower end of the flexible reservoir 26-1 is conical, or shaped in a manner similar to a large funnel terminating in the conduit 106. In addition, the reservoir assembly including the deck 108 mounted on the floats 104 may be secured in position to the pilings 56 by cells 110; and additional weights 112 and cables 114 may provide supplemental stability. In an alternative arrangement shown in FIG. 8, the water feed arrangements for the fresh water reservoirs 26 may be implemented as shown, by the main fresh water conduit 116. Also, individual conduits 118 may be selectively coupled to the main conduit 116 by valves 120. If desired, these valves may be manually operated from the decking 48 extending between the floats 46. Alternatively, automatic valving controls actuated from the central control station 32, as shown in FIG. 1, may be employed.

Incidentally, because fresh water is slightly lighter than salt water, as the reservoirs 26 are individually emptied, the lower ends of the flexible reservoirs will tend to collapse or rise. Also, the level of the water within the reservoirs 26, being fresh water, will be slightly higher than that outside of the reservoirs, in the harbor. Accordingly, the top few feet of the reservoir arrangements must be made somewhat sturdier to withstand the slight outward pressure which is generated by this difference in head, in locations where the floats are not present.

Concerning specific illustrative dimensions, it is contemplated that the reservoirs will be made of relatively heavy flexible plastic material, such as semi-rigid vinyl, in the order of eight to twenty mils thick, and that the reservoirs will be several tens of feet in length, width and depth, with a typical individual reservoir being in the order of 40 to 60 feet wide, 100 feet long and a depth of perhaps 40 to 80 feet if the water is sufficiently deep. The floats may be in the order of 10 to 25 feet in diameter, with a diameter of about 20 feet being preferred.

In conclusion, it is understood that the foregoing detailed description and the accompanying drawings merely illustrate the principles of the present invention. Other alternative arrangements including somewhat different float and support arrangements, as well as alternative arrangements for picking up the fresh water and supplying it to the flexible reservoirs in the ocean, are of course within the scope of the invention. In addition, if desired, two separate conduits between the offshore reservoirs and the mainland pumping station and/or pickup point may be provided so that transfer of water from any desired reservoir to the pumping station may be accomplished concurrently with initial filling up of other reservoir units. Also, the present storage arrangements could be used for other commodities, like grain, coal, or etc. Accordingly, the present invention is not limited to that precisely as shown and described.

What is claimed is:

1. A multiple purpose system for the storage of runoff water, and for its utilization during arid seasons comprising:

means located at a rain-water runoff channel at a point near the ocean for collecting fresh water;

flexible storage reservoir means mounted in the ocean in a protected area for storing the collected fresh water;

conduit means for supplying fresh water to said reservoirs from said fresh water collecting means;

means for filtering and treating the collected water;

pumping station means for distributing the collected fresh water;

said reservoir means including a plurality of flexible walled tanks;

float means extending along the upper edges of said reservoirs partially in and partially extending above the ocean to support the edges of said reservoirs and preclude mixing of the fresh water with salt water from the ocean;

deck means supported on said float means for covering the top surface of each of said reservoirs for preventing the entrance of sea water, and for providing recreational commercial areas on said decks;

means for selectively filling said float means partially with water to stabilize them and control their buoyancy;

bridge means extending from said deck means to shore to provide access to said decks for recreational or commercial purposes; and means located adjacent said container for protecting said reservoir and deck means against waves, said protecting means including a two-stage system including an outer means for initially reducing the force of waves, and an inner means mounted between said outer means and said reservoir and deck means for further reducing the force of the waves.

2. A water system as defined in claim 1 wherein a single conduit extends from said reservoir means to said collection point and said pumping station means, and wherein means are provided for alternatively transmitting water in one direction through said conduit means to said reservoir means when water is being collected, and for transmitting water in the opposite direction through said conduit means for distribution.

3. A water system as defined in claim 1 including a plurality of reservoirs each of which is more than 40 feet in length, width and depth.

4. A multiple purpose system for the storage of runoff water, and for its utilization during arid seasons comprising:

means located at a rain-water runoff channel at a point near the ocean for collecting fresh water;

flexible storage reservoir means mounted in the ocean in a protected area for storing the collected fresh water;

conduit means for supplying fresh water to said reservoirs from said fresh water collecting means;

means for filtering and treating the collected water;

pumping station means for distributing the collected fresh water;

said reservoir means including a plurality of flexible walled tanks;

float means extending along the upper edges of said reservoirs partially in and partially extending above the ocean to support the edges of said reservoirs and preclude mixing of the fresh water with salt water from the ocean;

deck means supported on said float means for covering the top surface of each of said reservoirs for preventing the entrance of sea water, and for providing recreational commercial areas on said decks;

means for selectively filling said float means partially with water to stabilize them and control their buoyancy; and bridge means extending from said deck means to shore to provide access to said decks for recreational or commercial purposes.

5. A reservoir system as defined in claim 4 wherein said container is more than 40 feet in length, width and depth.

6. A reservoir system as defined in claim 4 wherein said floats are cylindrical and are more than 10 feet in diameter.

7. A reservoir system as defined in claim 4 further comprising means located adjacent said container for protecting said container against waves.

8. A system as defined in claim 7 wherein said wave protecting means includes an open net of cables for initially reducing the force of waves, and sheet means mounted adjacent said net of cables for further reducing the force of the waves.

9. A system as defined in claim 8 wherein said sheet means is provided with openings.

10. A system as defined in claim 8 wherein two adjacent sheets are provided, with the sheet closest to said net of cables being provided with openings.

* * * * *